US009738077B2

(12) United States Patent
Pourtier

(10) Patent No.: US 9,738,077 B2
(45) Date of Patent: Aug. 22, 2017

(54) METHOD AND DEVICE FOR PARTIAL MAINTENANCE OF A HYDRAULIC CIRCUIT

(71) Applicant: Dover Europe Sàrl, Vernier (CH)

(72) Inventor: Francis Pourtier, Charmes sur Rhone (FR)

(73) Assignee: DOVER EUROPE SÀRL, Vernier (CH)

( * ) Notice: Subject to any disclaimer, the term of this patent is extended or adjusted under 35 U.S.C. 154(b) by 0 days.

(21) Appl. No.: 15/151,980

(22) Filed: May 11, 2016

(65) Prior Publication Data

US 2016/0332449 A1 Nov. 17, 2016

(30) Foreign Application Priority Data

May 13, 2015 (FR) ..... 15 54353

(51) Int. Cl.

| | |
|---|---|
| ***B41J 2/165*** | (2006.01) |
| ***B41J 2/175*** | (2006.01) |
| ***B41J 2/18*** | (2006.01) |
| ***B41J 2/185*** | (2006.01) |
| ***B41J 29/17*** | (2006.01) |

(52) U.S. Cl.

CPC ..... *B41J 2/16552* (2013.01); *B41J 2/17563* (2013.01); *B41J 2/17596* (2013.01); *B41J 2/18* (2013.01); *B41J 2/185* (2013.01); *B41J 29/17* (2013.01); *B41J 2002/16594* (2013.01); *B41J 2002/1853* (2013.01)

(58) Field of Classification Search

CPC . B41J 2/16552; B41J 2/17563; B41J 2/17596

See application file for complete search history.

(56) References Cited

U.S. PATENT DOCUMENTS

| | | | | |
|---|---|---|---|---|
| 5,459,497 | A | 10/1995 | Manning | |
| 6,145,954 | A * | 11/2000 | Moore | B41J 2/1707 347/28 |
| 2002/0038611 | A1 | 4/2002 | Naniwa | |
| 2008/0100660 | A1 | 5/2008 | Perrin | |
| 2011/0085009 | A1 * | 4/2011 | Tomlin | B41J 2/175 347/85 |
| 2016/0039216 | A1 | 2/2016 | Ribiero | |

(Continued)

FOREIGN PATENT DOCUMENTS

| | | |
|---|---|---|
| EP | 1 827 843 | 9/2007 |
| JP | 2001-071532 A | 3/2001 |
| WO | 2006/067227 A1 | 6/2006 |

OTHER PUBLICATIONS

Extended European Search Report issued in Patent Application No. EP 16 16 9214 dated Sep. 28, 2016.

(Continued)

*Primary Examiner* — Jason Uhlenhake

(74) *Attorney, Agent, or Firm* — Pearne & Gordon, LLP

(57) ABSTRACT

The invention relates to a method of cleaning a fluid circuit in an inkjet printer that comprises a print head connected to the fluid circuit through an umbilical (19), and also comprises means (50) of recovering fluid from the print head (1), this method comprising at least sending solvent to said fluid recovery means (50), without making this solvent flow in the umbilical or in the print head.

19 Claims, 7 Drawing Sheets

(56) References Cited

U.S. PATENT DOCUMENTS

2016/0052291 A1 2/2016 Pourtier

OTHER PUBLICATIONS

Search Report issued in French Patent Application No. FR 1554353 dated Mar. 22, 2016.
U.S. Appl. No. 15/088,190, "Method and Device for Maintenance and Protection of a Hydraulic Connection" filed Apr. 1, 2016.
U.S. Appl. No. 61/301,723, "Measuring System in a Fluid Circuit of a Continuous Inkjet Printer, Related Fluid Circuit and Block Designed to Implement said Measuring System" filed Feb. 5, 2010.

* cited by examiner

METHOD AND DEVICE FOR PARTIAL MAINTENANCE OF A HYDRAULIC CIRCUIT

TECHNICAL DOMAIN AND PRIOR ART

The invention relates to the field of printers, and particularly continuous inkjet (CU) type printers.

It also relates to the architecture (the layout of the Ink circuit) of a printer, for example of the CIJ type, and particularly to prevent situations in which some channels along which ink passes can become blocked during use.

Continuous inkjet (CIJ) printers are well known in the field of industrial coding and marking of miscellaneous products, for example for marking barcodes, Best Before dates on food products or references or distance marks on cables or pipes directly on the production line at high speed. This type of printer is also used in some decoration fields in which the possibilities of industrial graphic printing are used.

These printers have several typical subassemblies, as shown in FIG. 1.

Firstly, a print head 1, used usually offset from the body of the printer 3, is connected to it through a flexible umbilical 19 containing hydraulic and electrical connections necessary for operation of the head, while providing it with flexibility to facilitate integration on the production line.

The body of the printer 3 (also called the console or cabinet) usually contains three subassemblies:

- an ink circuit in the lower part of the console (zone 4'), that firstly supplies an appropriate quality of ink to the head at a stable pressure, and secondly handles ink output from jets that is not used for printing;
- a controller located in the top of the console (zone 5'), capable of managing sequences of actions and performing processing to activate different functions of the ink circuit and the head;
- an interface 6 that provides the operator with the means of using the printer and remaining informed about its operation.

In other words, the cabinet comprises 2 subassemblies: electronics, the electrical power supply and the operator interface at the top, and the ink circuit supplying nominal quality ink under pressure to the head and the negative pressure at which ink not used by the head is recovered, at the bottom.

FIG. 2 diagrammatically shows a print head 1 of a CIJ printer. It comprises a drop generator 60 supplied with electrically conducting ink pressurised by the ink circuit (in zone 4').

This generator is capable of emitting at least one continuous jet through a small dimension orifice called a nozzle. The jet is transformed into a regular succession of identically sized drops under the action of a periodic stimulation system (not shown) located upstream from the nozzle outlet. When the drops 7 are not used for printing, they are directed towards a gutter 62 that recovers them to recycle unused ink and return it into the ink circuit 4. Devices 61 placed along the jet (charge and deflection electrodes) can electrically charge the drops on command and deflect them in an electrical field Ed. They are then diverted from their natural ejection trajectory from the drop generator. The drops 9 intended for printing escape from the gutter and will be deposited on the support 8 to be printed.

This description can be applied to continuous ink jet (CU) printers said to be binary or multi-deflected continuous jet. Binary CIJ printers are provided with a head of which the drop generator has a large number of jets, and each drop from a jet can be oriented towards only 2 trajectories, either print or recovery. In multi-deflected continuous jet printers, each drop from a single jet (or from a few jets at intervals from each other) can be deflected on various trajectories corresponding to commands with different charges from one drop to another, thus scanning the zone to be printed along one direction called the deflection direction, the other scanning direction of the zone to be printed is covered by relative displacement of the print head and the support 8 to be printed. Elements are usually arranged such that these two directions are approximately perpendicular to each other.

An ink circuit of a continuous inkjet printer can firstly provide ink under regulated pressure, and possibly solvent, to the drop generator of the head 1 and can create a negative pressure to recover fluids returned from the head not used for printing.

It is also possible to manage consumables (distribution of ink and solvent from a reservoir) and to control and maintain the ink quality (viscosity/concentration).

Finally, other functions are related to the comfort of the user and automatic control over some maintenance operations so as to guarantee identical operation regardless of usage conditions. These functions include rinsing the head (drop generator, nozzle, gutter) with solvent, assistance with preventive maintenance such as the replacement of limited life components (filters, pumps).

These various functions have very different end purposes and technical requirements. They are activated and sequenced by the printer controller 5' that will become increasingly complex as the number and sophistication of the functions increase.

Concerning the inks used, inks containing pigments, for example titanium oxide ($TiO_2$ rutile or anatase), in the form of sub-micronic particles, are particularly useful for their whiteness and opaqueness. They are called pigment inks and are used for marking and identification of black or dark supports.

But dense pigment particles naturally tend to settle, particularly inside ink supply conduits, when the ink is at rest. The consequences of this sedimentation may be the formation of solid plugs in these conduits, that can partially or completely block them. Furthermore, during essential maintenance operations, exposing connections to air in the presence of ink can cause the formation of dry ink plugs. The same problem also arises with the connection cannula between the ink cartridge and the ink circuit; ink is supplied to the circuit from a cartridge that is a consumable element that the user replaces when it is empty. The connection to the ink circuit is made through a cannula that fits into an adapted opening in the cartridge and that will also form an ink sedimentation zone in which solid plugs can be formed.

The main result is difficulties in supplying ink and loss of opaqueness of the markings.

These problems are critical and action by a technician is necessary because ink cannot be stirred when it is in the connection ducts and means; the printer is then blocked and production is stopped, which means that the user is discontented and there is a resulting loss of time and extra costs.

In the specific field of inkjet printers, there is no known technique for solving these connection blockage problems, particularly in the cannula or in conduits or in pipes in which ink circulates.

Moreover, some parts of the circuit may require cleaning (particularly if blocking problems like that mentioned above occur), without other parts of the circuit being concerned by this problem. The currently used technique consists of sending solvent throughout the circuit, including in parts in which it is not necessary. This operation takes a long time, requires a total shutdown of the machine and causes higher solvent consumption than is necessary. In general, consumables used in this type of device and particularly the solvent, are expensive elements.

Therefore, the problem arises of creating an ink circuit and a functioning method for an ink circuit, by which it is possible to optimise cleaning of the hydraulic connections in an optimum and appropriate manner, particularly in the case of a pigment ink.

It is also required to find a method of performing such cleaning during the various operational and non-operational phases of an inkjet printer.

It is also required to minimise solvent consumption while rinsing or cleaning conduits and connections forming part of the ink circuit, for example in the case of a blockage.

The same problem arises for any ink, even if it is not a pigment ink, that can dry and form deposits of dry material in the conduits and connections of the ink circuit.

PRESENTATION OF THE INVENTION

The invention relates firstly to a method of cleaning a fluid circuit in an inkjet printer that comprises a print head connected to the fluid circuit through a flexible umbilical (or conduit), and also comprises means or a circuit for recovering fluid from the print head, this method including at least sending solvent to said fluid recovery means without making this solvent flow in the umbilical or in the print head.

Therefore, with a method according to the invention, solvent can be sent to the fluid recovery means or circuit without making it flow in the umbilical or the print head. Therefore, solvent is injected directly into the fluid recovery means or circuit, which saves fluid and time during a cleaning process.

This method has the following advantages:

- since the solvent used for cleaning the fluid recovery circuit has flowed in neither the print head nor the umbilical, this solvent is clean, which improves cleaning performances;
- ink inside the head is not diluted with solvent; thus, the printer can be restarted more quickly after cleaning, saving solvent.

The fluid circuit may also comprise a main reservoir, ink supply means to this main reservoir and means by which solvent can enter these ink supply means, that are preferably closed when solvent is sent to said fluid recovery means. In other words, the solvent is then not injected into these ink supply means while solvent is being sent to the fluid (returning from the print head) recovery means or circuit.

According to one embodiment, sending of solvent to said fluid recovery means is stopped and said means are then opened to allow solvent to enter the ink supply means. In other words, solvent is then no longer injected into the fluid recovery means or circuit, but rather into the ink supply means.

According to another embodiment, the method stops sending solvent to said fluid recovery means or to the ink supply means, and solvent is then sent to the print head. In other words, solvent is no longer injected into the means or circuit for recovering fluid from the print head, nor into the ink supply means, but only into the print head.

It is thus possible to send solvent exclusively to the means or circuit of recovering fluid from the print head, or exclusively to the ink supply means or exclusively to the print head. Each time, there is a saving of fluid and time during a cleaning procedure.

A method according to the invention can thus selectively send solvent to one of the parts of the fluid circuit.

A blocked state of the recovery means can be detected before solvent is sent to said fluid recovery means.

For example, fluid recovery means comprise pumping means, and a recovery means blocked state (for example a blocked state of the pumping means) is detected by at least one measurement of the pressure variation during or after a start-up phase of said pumping means.

If the detected pressure variation is not negative or if its absolute value is less than a predetermined value, then a blocked state of the recovery means can be detected.

According to an embodiment, after a blocked state of the recovery means has been detected, at least one step can be performed to unblock these means, for example by at least one step to send solvent under pressure into the recovery means.

For example, an unblocked state can be detected when a minimum volume ($\Delta V$) of recovered solvent flows towards the recovery means.

Preferably, a valve, for example a 3-way valve, or a set of valves, for example a set of 2 valves, can be used to select the fluid inlet into the fluid recovery means.

The invention also relates to a circuit or means for recovery of fluid from the print head of an inkjet printer, which may also comprise ink supply means, said print head being for example designed to be connected to the printer body through a flexible umbilical or conduit, said circuit comprising at least one pump and means of supplying said pump, exclusively either with recovered fluid (from the print head) or with solvent that has not flowed in the umbilical or in the print head.

The advantages presented above are valid in this case:

- this recovery circuit can be used to receive clean solvent, which improves the cleaning performance;
- furthermore, the ink in the head is not diluted with solvent; thus, the printer can be started or restarted more quickly after cleaning, saving solvent.

According to one embodiment, the means of supplying said pump, either with recovered fluid or with solvent, comprise a 3-way valve or a set of valves, for example a set of 2 valves (one for controlling a flow of fluid returning from the print head, the other one being for controlling a flow of clean solvent).

Therefore, the invention also relates to a circuit or means for recovery of fluid from a print head of an ink jet printer, which may also comprise ink supply means, said print head being for example designed to be connected to the printer body through a flexible umbilical or conduit, said circuit comprising at least one pump and a set of one or more valves (for example a 3-way valve or a couple of 2-way valves), that in one position (or in one state of the valves of the plurality of valves) allows recovering fluid from a print head, and in another position (or in another state of the valves of the plurality of valves) causes flow of solvent that has flowed neither in the umbilical nor in the print head.

The advantages presented above are again applicable in this case.

A filter may be placed in series with said pump.

A circuit according to the invention preferably comprises means of detecting a blocked state of the recovery circuit or of the means for recovery of fluid from a print head, for example means of detecting pressure variation during or after a start-up phase of said pump.

Means may also be provided to detect whether the absolute value of said pressure variation is greater or less than a predetermined value.

Means may also be provided to perform at least one step for unblocking the recovery circuit, for example means of sending clean solvent under pressure into the recovery circuit.

Such a circuit also advantageously comprises means of detecting a solvent volume sent to the recovery means.

A circuit or means for recovery of fluid from the print head of an inkjet printer may be combined with means for sending or injecting solvent and/or with a main reservoir, and/or ink supply means to said main reservoir and/or means by which solvent can enter these ink supply means.

According to one embodiment, control means, preferably control means of said inkjet printer, may control, or may be programmed to control, said means by which solvent can enter these ink supply means, preferably so that they are closed when solvent is sent to said fluid recovery means. In other words, the solvent is then not injected into these ink supply means while solvent is being sent to the fluid (from the print head) recovery means or circuit.

According to one embodiment, control means, preferably control means of said inkjet printer, control or may be programmed to control, the means for sending or injecting solvent so as stop sending solvent to said circuit or means to recover fluid and control said means by which solvent can enter these ink supply means so that they open to allow solvent to enter the ink supply means. In other words, solvent is then no longer injected into the fluid recovery means or circuit, but rather into the ink supply means.

According to another embodiment, control means, preferably control means of said inkjet printer, control or may be programmed to control, the means of supplying said pump of said circuit or means for recovery of fluids, and said means by which solvent can enter these ink supply means, so that solvent is no longer sent to said fluid recovery means or to the ink supply means, and so that solvent is sent to the print head. In other words, solvent is no longer injected into the fluid means or circuit for recovering fluid from the print head, nor into the ink supply means, but only into the print head.

Control means may thus be programmed to control the circuit to send solvent exclusively to the means or circuit of recovering fluid from the print head, or exclusively to the ink supply means or exclusively to the print head. Each time, there is a saving of fluid and time during a cleaning procedure.

The invention also relates to a solvent supply circuit for an inkjet printer, which may comprise a print head, ink supply means and means of recovering fluid from the print head, this circuit comprising means of storing solvent and means of sending solvent according to at least three different channels.

For example, this circuit comprises:

- first means of sending solvent to ink supply means;
- second means different from first means for sending solvent to a print head;
- and third means different from each of the first and second means, of sending solvent to the means or circuit of recovering fluid from the print head, without solvent flowing in the print head and without solvent being sent to the ink supply means.

Therefore such a circuit comprises at least 3 solvent outlet or supply channels, in order to supply at least 3 circuits or means that form part of the printer fluid circuit. These various channels are arranged at least partly in parallel.

Each of the first means, second means and third means, may comprise one or more valves and/or one or more conduits.

The first means may send solvent to the ink supply means without solvent flowing in the print head (and/or without solvent flowing in a flexible umbilical or conduit connected to said print head) and without solvent being sent to the means of recovering fluid from the print head. Means for example in the form of one or several valves, can allow solvent flow to one or another of these channels.

Therefore a method according to the invention that uses such a solvent supply circuit can send solvent to one of the means that form part of the fluid circuit of an inkjet printer, for cleaning or for rinsing, for example:

- a circuit or means for supplying a main reservoir with ink;
- a circuit or means of recovering fluid from a print head, particularly of the type according to the invention, as described above;
- the print head itself.

According to one embodiment, the supply to each of these means may be exclusive for each of these means. For example, the means or circuit of recovering fluid from a print head may be supplied with solvent, while neither the circuit (nor means) for supplying a main reservoir with ink, nor the print head, are supplied with solvent.

In any method or circuit according to the invention, the flexible umbilical or flexible conduit may contain one or more hydraulic conduit(s) for the supply of ink and/or solvent to the print head and for the return of ink and/or solvent from the print head. Said one or more hydraulic conduit(s) for the supply of ink and/or solvent to the print head and for the return of ink and/or solvent from the print head are therefore contained in a same flexible umbilical or flexible conduit. But at least part or all of the ink supply means (for example from an ink cartridge) to said main reservoir do not belong to said flexible umbilical or flexible conduit.

In any method or circuit according to the invention, a circuit, or means, to recover fluid (ink and/or solvent) from the print head is/are, or may be, or are designed to be, arranged on the downstream side of the flexible umbilical or conduit relative to the flow direction of ink and/or solvent returning from the print head (the print head forming the upstream side of the flexible umbilical or conduit): ink and/or solvent returning from the print head circulates through the umbilical or conduit and, upon leaving the umbilical or conduit enters the circuit, or means, to recover fluid (ink and/or solvent) from the print head.

In any method or circuit according to the invention, different circuits, or different elements or components of a same circuit are connected by at least one conduit and/or at least one valve.

The invention also relates to an inkjet printer comprising:

- a print head:
- a circuit, according to the invention, for example according to one of the embodiments presented above, to recover fluid from said print head;
- a solvent supply circuit for example like that according to the invention, for example according to one of the embodiments presented above.

Such an inkjet printer may also comprise ink supply means, the solvent supply circuit possibly sending solvent to the print head or to the circuit to recover fluid from said print head, or to the ink supply means.

The invention also relates to an ink circuit of a continuous inkjet printer comprising at least one reservoir called the main reservoir, and printer control means that are adapted or programmed to use a method according to the invention and/or to control a circuit or a device or a circuit according to the invention.

Electrical connection means can supply electrical power to said print head.

The inkjet printer used in a method according to the invention or in a device according to the invention may be a continuous inkjet (CU) printer, particularly of the binary type, or a multi-deflection continuous inkjet printer.

The invention also relates to a printing method implementing an inkjet printer according to the invention.

DETAILED DESCRIPTION OF EMBODIMENTS

Figure 3:
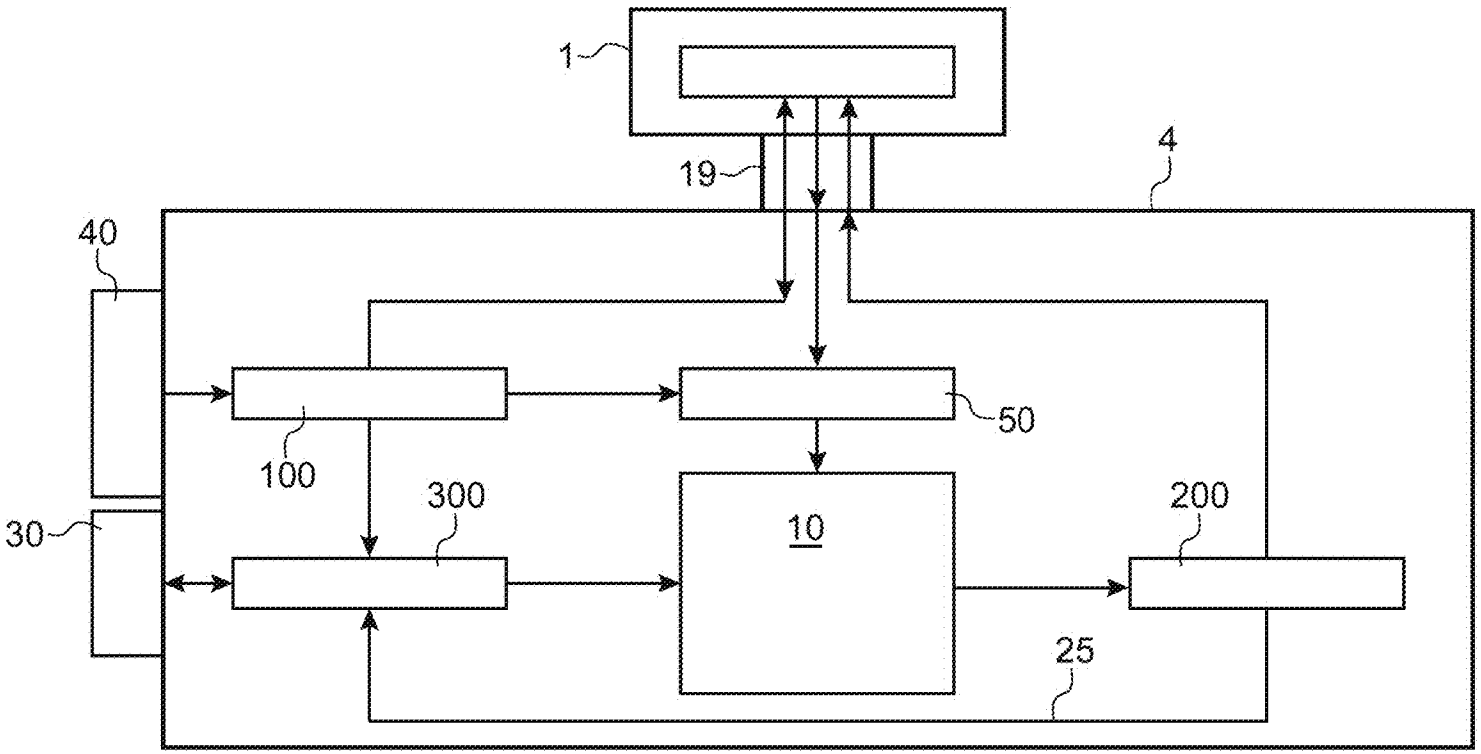
FIG. 3 is an example of a fluid circuit according to this invention.

One example of an architecture of the fluid circuit of a printer according to the invention, or in which the invention can be applied, is shown in FIG. 3 on which references identical to those used above denote identical or corresponding elements. In particular, there is the flexible umbilical 19 that contains all hydraulic and electrical connections to the print head 1, to which the printer architecture described below can be related.

A fluid recovery circuit or means 50 according to the invention will be described below.

A fluid storage and transfer circuit or means 100 according to the invention will be described below.

We shall start by describing a fluid circuit 4 to which at least one of the circuits according to the invention may be applied, in FIG. 3.

FIG. 3 shows that the fluid circuit 4 of the printer comprises a plurality of means 10, 50, 100, 200, 300, each means being associated with a specific function. A removable ink cartridge 30 and a solvent cartridge 40 that is also removable are associated with this circuit 4. Although the presence of cartridges can be recommended, including when stopped (for example to enable active monitoring), the ink circuit may be without the cartridges 30, 40 when stopped or at rest.

Reference 10 refers to the main reservoir that contains a mix of solvent and ink.

Reference 100 refers to all means that are used to draw off and possibly store solvent from a solvent cartridge 40 and to supply solvent thus drawn off to other parts of the printer, either to supply the main reservoir 10 with solvent, or to clean or maintain one or several of the other parts of the machine.

Reference 300 refers to all means of drawing off ink from an ink cartridge 30 and supplying the ink thus drawn off to supply the main reservoir 10. As can be seen on this figure, according to the embodiment disclosed herein, these means 300 are used to send solvent from means 100 to the main reservoir 10.

At the outlet from the reservoir 10, a set of means globally denoted as reference 200, is for pressurising ink drawn off from the main reservoir and for sending it to print head 1. According to one embodiment disclosed herein by arrow 25, it is also possible that these means 200 can be used to send ink to the means 300, and then once again to the reservoir 10, which enables ink flow recirculation inside the circuit. This circuit 200 also allows draining the reservoir in the cartridge 30 and also cleaning of the connections of the cartridge 30 (in the case of the embodiment in FIG. 6, by changing the position of the valve 37).

The system shown on this figure also comprises means 50 of recovering fluids (ink and/or solvent) that returns from the print head, more precisely from the gutter 62 of the print head or from the head rinsing circuit. Therefore these means 50 are arranged on the downstream side of the umbilical 19 (relative to the flow direction of fluids returning from the print head).

As can be seen on FIG. 3, the means 100 also allow sending solvent directly to these means 50 without passing through the umbilical 19 or the print head 1 or the recovery gutter 62.

The means 100 comprise at least three parallel solvent supplies, one to the head 1, the $2^{nd}$ to means 50 and the $3^{rd}$ to means 300.

Each of the means described above is provided with means such as valves, preferably solenoid valves, for guiding the fluid concerned to the chosen destination. Thus, means 100 can be used to send solvent exclusively to head 1, or to means 50 or to means 300.

Therefore, it is possible for example to:

a) clean or rinse means 50 with solvent, no solvent being sent to the means 300 or to the head 1 during this step;

b) then possibly clean or rinse means 300, no solvent being sent to the means 50 or to the head 1 during this step;

c) then possibly clean or rinse head 1, no solvent being sent to the means 50 or 300 during this step.

The order of steps a), b), c) may possibly be different from that mentioned above.

Furthermore, one of steps a)-c) may be performed while other processes are taking place; for example it is possible:

during step a) and/or during step c), to make an ink transfer from the cartridge 30 to the reservoir 10;

and/or, during step b), to print using the head 1.

Therefore, partial rinsing according to the invention not only saves fluid (solvent) and time, but also it does not prevent other parts of the printer from performing some tasks. Therefore, it is economically very advantageous. The solvent used for this partial rinsing can also be recovered in the main reservoir 10.

As a variant, with the same means, it is possible to send solvent to all means forming part of the ink circuit, for example for general rinsing of the circuit.

Each of the means 50, 100, 200, 300 described above is provided with a pump that is used to process the fluid concerned (the $1^{st}$ pump, $2^{nd}$ pump, $3^{rd}$ pump, $4^{th}$ pump) respectively. These various pumps perform different functions (the functions of their corresponding means) and are therefore different from each other, although these different pumps may be of the same type or a similar type (in other words, none of these pumps performs 2 of these functions).

In particular, the means 50 comprise a pump ($1^{st}$ pump) that pumps recovered fluid as disclosed above, from the print head and sends it to the main reservoir 10. This pump is dedicated to recovery of this fluid from the print head and is physically different from the $4^{th}$ pump of the means 300 dedicated to ink transfer or from the $3^{rd}$ pump of means 200 dedicated to pressurisation of the ink at the outlet from the reservoir 10.

The means 100 comprise a pump (the $2^{nd}$ pump) that pumps solvent and sends it to the means 50 and/or the means 300 and/or to the print head 1.

Figure 4:
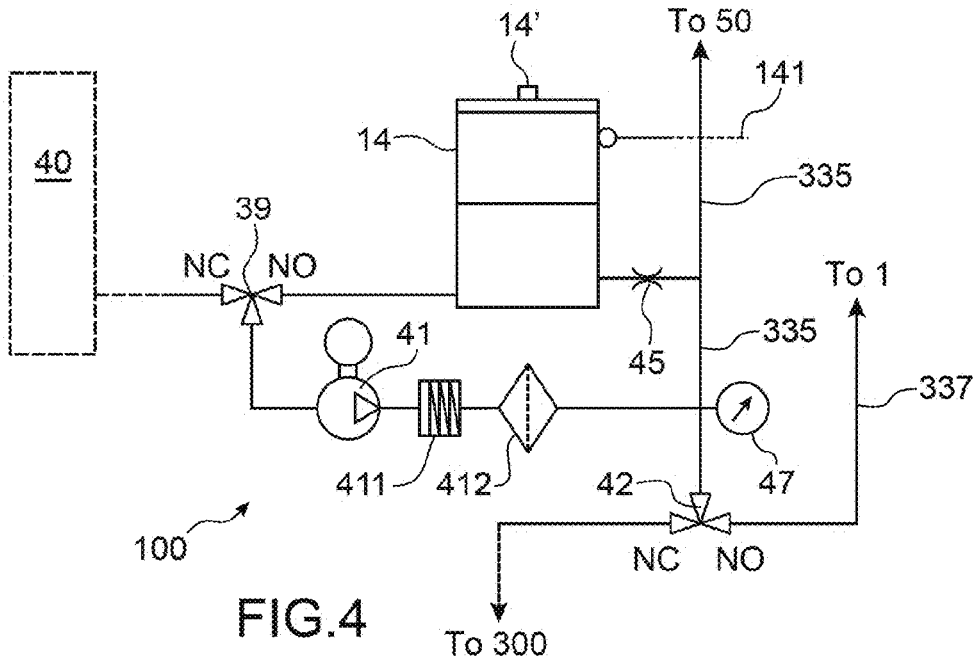
FIG. 4 is an example of a solvent circuit according to this invention.

FIG. 4 shows an even more detailed representation of means 100 that draw off solvent from a cartridge 40 and send it to the different parts of the device, for example to perform cleaning or unblocking operations, or to supply solvent to the main reservoir 10.

These means comprise a pump 41 (the $2^{nd}$ pump) and various fluid connection means, each comprising one or several conduits or one or several valves 39, 42. One of these valves, the valve 42, guides solvent to 2 possible channels, namely the print head 1 or the ink supply circuit 300. In the latter case, when the means that enable solvent to enter means 300 are themselves closed, solvent is guided to means 50. An anti-pulsation device 411 and a filter 412 may also be arranged in series with the pump.

An intermediate reservoir 14 may also be provided that may be provided with level measurement means 14' and that may be supplied from a cartridge 40, when the cartridge is connected to the circuit.

This reservoir 14 may send solvent to the various means 50, 300 and/or to the print head 1, to clean them or to unblock their hydraulic components; it may also supply solvent to the main reservoir 10. Solvent can also be drawn off from the cartridge 40 and sent directly to the various elements of the circuit, to perform the same operations (cleaning or unblocking or supply of the main reservoir 10). The source of the solvent is selected by a valve 39. The <<normally open>> (NO) and <<normally closed>> (NC) positions of each valve are shown on this figure, as on the others. In this case, if the valve 39 is in the <<NC>> position (FIG. 4), solvent is pumped from the cartridge 40, and if it is in the <<NO>> position, solvent is pumped from the reservoir 14.

The reservoir 14 may be supplied from the cartridge 40, for example through a calibrated leak or restriction 45 located at its inlet. This leak also participates in generating pressure. The reservoir 14 may be filled as follows; the valve 39 is in the <<NC>> position (see FIG. 4), so that solvent can be pumped from cartridge 40 through the pump 41. The valve 42 is in the closed (NC) position, while inlets to means 50 and 300 are prohibited to solvent.

Solvent can be sent to these various means 50 (through the conduit 335), 300, then possibly to the main reservoir 10, and/or to the print head 1 (through conduit 337) using valve 42 and means located at the inlet to means 50, 300, for example one inlet valve for each of these means. Therefore, 3 parallel channels are defined at the outlet from means 100 that, depending on the needs, will be used to send solvent to one and/or the other of these elements.

Means 100 may also comprise means 47 forming the pressure sensor, to measure the solvent pressure at the outlet from pump 41 and means 411, 412. This information can be used to detect a pressure increase in the solvent, which can be the result of a blockage in one of the conduits in which solvent flows.

Figure 1:
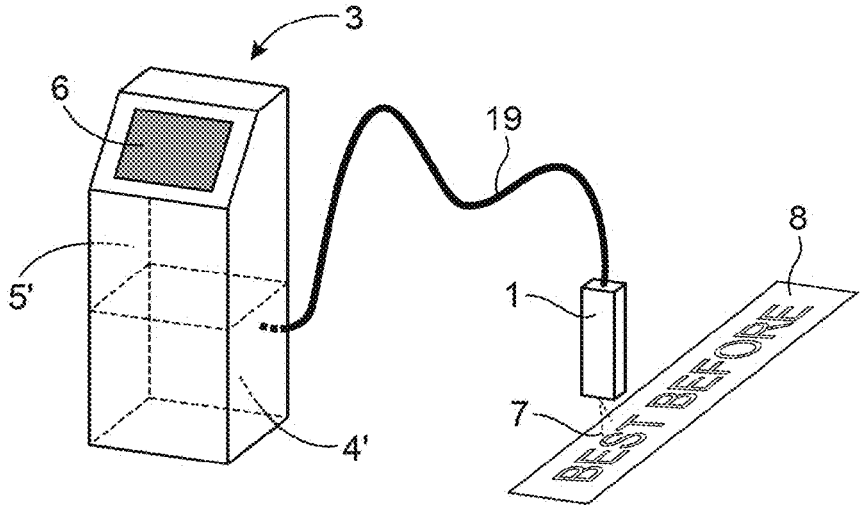
FIG. 1 shows a known printer structure.
Figure 2:
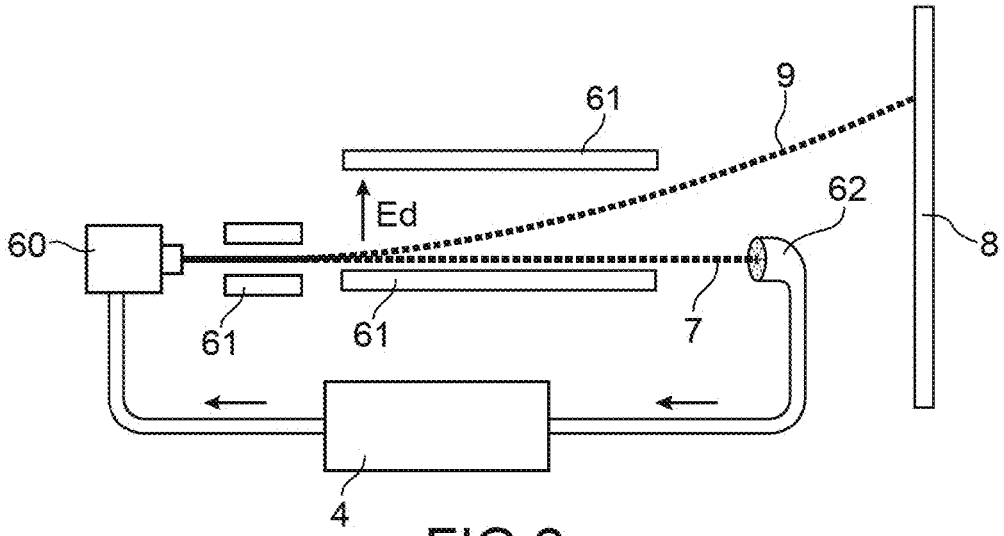
FIG. 2 shows a known structure of a print head of a CIJ type printer.
Figure 5A:
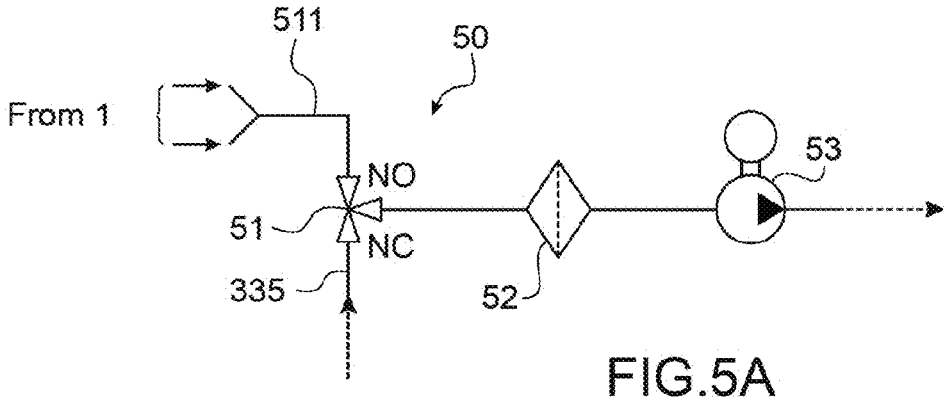
FIGS. 5A and 5B are examples of a recovery circuit according to this invention.

FIG. 5A shows a more detailed representation of one embodiment of means 50 that allow recovery of fluids (ink and/or solvent) that returns from the print head. Therefore, two types of fluid can be brought together at the inlet to these means 50; ink from the recovery gutter 62 (see FIG. 2) and solvent that was used to clean or rinse the print head 1 and/or the umbilical 19. A conduit 511 guides these fluids to the inlet to means 50.

These means comprise a pump 53 (the $1^{st}$ pump), possibly a filter 52 arranged in series with this pump, for example upstream from the pump, and means 51 forming the inlet valve. These means 51 comprise one or several valves, preferably a three-way valve. They exclusively send fluid either from head 1 (NO position of the valve in FIG. 5A) through the conduit 511, or solvent from means 100 (NC position of the valve in FIG. 5A) through the conduit 335, to the pump 53.

Fluid pumped by the pump 53 can then be sent to the main reservoir 10.

Figure 5B:
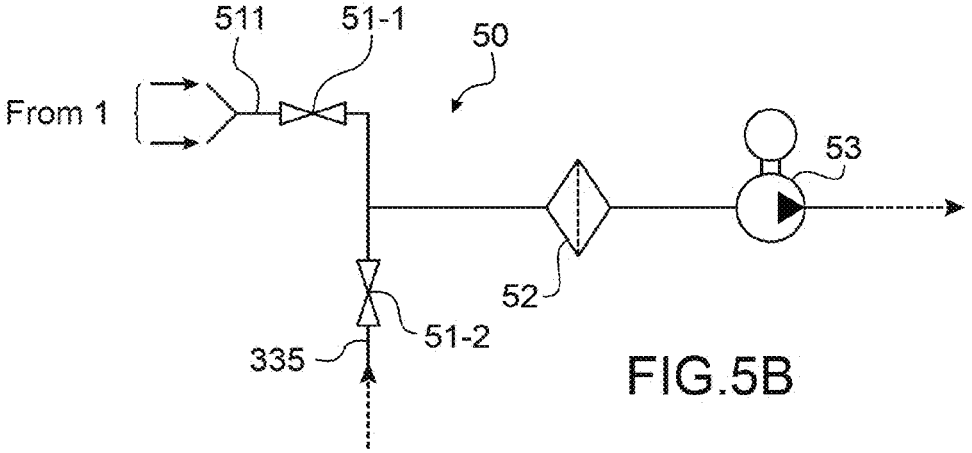

FIG. 5B shows a variant of FIG. 5A. On FIG. 5B, 2 valves 51-1 and 51-2 are implemented, instead of a three-way valve. Valve 51-1 is on conduit 511, and makes it possible to interrupt a flow of fluid returning from the print head 1; valve 51-2 is on a conduit through which clean solvent flows, and makes it possible to interrupt or block any flow of said clean solvent towards the pump 53. The other references on FIG. 5B are the same as on FIG. 5A and designate the same technical elements. Through the control of valves 51-1 and 51-2 (one of said valves being closed while the other one is open), this embodiment achieves the same result as with the one of FIG. 5A: fluid is exclusively sent either from head 1 (open position of valve 51-1 in FIG. 5B and closed position of valve 51-2) through the conduit 511, or solvent from means 100 (open position of the valve 51-2 in FIG. 5B and closed position of valve 51-1) through the conduit 335, to the pump 53.

Figure 6:
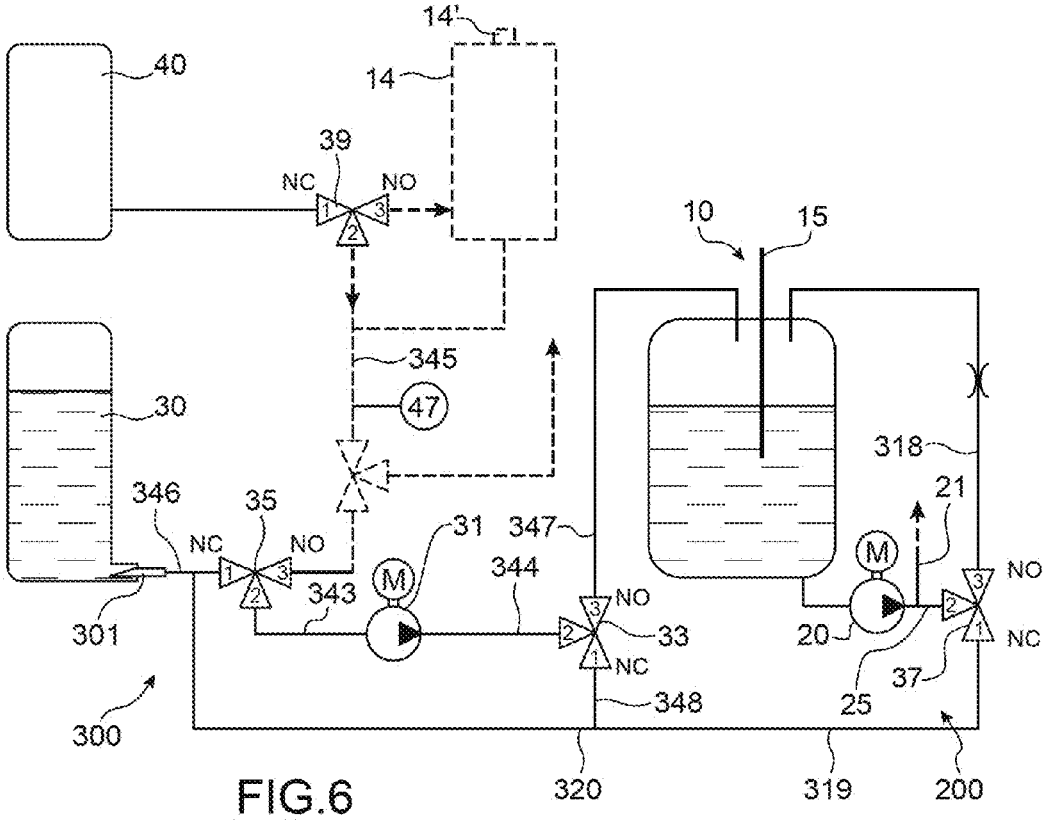
FIG. 6 is an example of an ink circuit, a main reservoir and a pressurisation circuit that can be used within the scope of this invention.

FIG. 6 shows a more detailed representation of means 300, in cooperation with the main reservoir 10 and the means 200.

The main reservoir 10 is preferably provided with means 15 for detecting the level of ink contained in it (in fact the ink in it is mixed with the solvent).

Reference 301 refers to the cannula (or any equivalent means), that will provide fluid connection between the cartridge 30 and the rest of the circuit.

When the cartridge 30 is in position and contains ink, ink may be pumped by pumping means 31 ($4^{th}$ pump) towards the main reservoir 10 through fluid connection means, comprising conduits 346, 343, 344, 347 and one or more valve(s) (or solenoid valves) 33, 35, that may be 3-way type valves. Thus, the ink transfer pump 31 pumps ink from the cartridge 30, and the ink passes in sequence through valves 35 and 33 (in positions <<12>>, or "NC", and <<23>>, or "NO" respectively in FIG. 6), and through conduits 343, 344, 347 to reach the main reservoir 10. The NO (respectively NC) state of the valve 35 corresponds to the position <<23>> (respectively <<12>>) creating connections between conduits 345 and 343 (respectively 346 and 343).

Means 345, 35, for example a conduit and a valve respectively (when the valve is in position <<32>> (NO) in FIG. 6) at the inlet to means 300, will be used to receive solvent from means 100. The means 300 will then increase the pressure of this solvent to a relative pressure (<<gauge pressure>>) equal for example to between 0 and 5 bars or between 0 and 10 bars, in fluid connection means.

This solvent may be directed through the conduits 343, 344 depending on the open or closed state of the valves 35 and 33:

- to reservoir 10 (through the conduit 347, valve 35 in position <<32>> (NO), valve 33 in position <<23>> (NO)), to add solvent into the reservoir 10;
- to conduits 320 (through the conduit 348, valve 35 in position <<32>> (NO), valve 33 in position <<21>> (NC)). Since the valve 37 is in the NO position, solvent can then be directed to the cartridge 30 through conduits 344, 348 and 320.

Means 200, at the outlet from the main reservoir 10, comprise a pump 20 ($3^{rd}$ pump, called the ink pressurisation pump), for pumping ink from the main reservoir 10 that can be directed either towards the main reservoir itself (through the return conduit 318) or towards the cartridge 30 itself (and into this cartridge) through one or several conduits 319, 320, The ink path at the outlet from the pump 20 may be controlled by means of one or several valves 37, preferably a 3-way valve. In FIG. 6, the position <<21>> (<<NC>>) of valve 37 directs the ink flow towards the conduit 319, and position <<23>> (<<NO>>) directs the ink flow towards the conduit 318. Ink is transferred to the print head 1 through a conduit 21 that collects ink downstream from the pump 20, from a point located between the outlet from the pump 20 and the valve 37. The print head itself contains a valve that may or may not authorise production of an ink jet, and possibly printing.

Generally, the instructions to activate pumps and valves are sent and controlled by the control means 3 (also called "controller"). In particular, these instructions will control flow of solvent under pressure, from means 100 to various other means 1, and/or 50, and/or 300 of the circuit (and possibly through these latter means 300 to the main reservoir 10).

The control means 3 may comprise a processor or microprocessor, programmed to implement a cleaning method according to the invention. These means control the opening and the closing of each valve, as well as the activation of the pumping means, in order to circulate ink and/or solvent as disclosed in this application. It also memorises data, for example ink and/or solvent level measurement data, and may also possibly process these data. The controller is also programmed to manage operations other than cleaning operations, particularly printing operations.

For safety reasons, the controller may make sure that the cartridge is still in position before any fluid, in particular solvent, is transferred to the cartridge 30, for example during cleaning operations. No operation will take place if no cartridge is in position.

Figure 7:
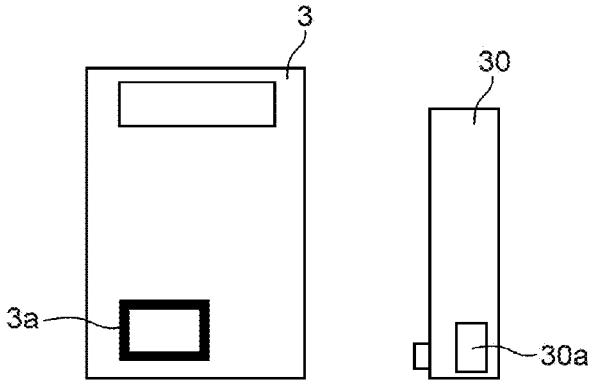
FIG. 7 shows an ink cartridge and means forming the controller of a printing machine.

To achieve this, as shown in FIG. 7, a cartridge 30 may be used which is provided with a circuit 30*a* (subsequently called a <<tag>>), for example made in the form of a processor or a microprocessor. This circuit 30*a* may for example be applied in contact with a wall of the cartridge 30. It may also comprise communication means, for example an RFID type interface, that can allow a dialogue or an exchange of information or data with the printer controller 3, particularly to provide it with one or more data that will be interpreted as representing the presence of the cartridge.

The controller 3 is also provided with communication means 3*a*, for example an RFID type interface, so that data transmitted by the cartridge tag can be received.

As a variant, communication between the body 3 of the printer and the cartridge 30 may be of the contact type. In this case contacts are provided, firstly on the cartridge, and secondly on the printer, to be sure that data are transmitted between the cartridge 30 and the printer. Presence of the cartridge can be detected by sending an RFID signal from the tag to the controller, or by the controller reading the presence of the tag contacts. This verification may be done periodically.

The controller 3 may also check the non-empty state of the cartridge 30 for example, before starting some or any cleaning operation, for example of the cannula 301. The empty state of the cartridge 30 may be detected particularly by variations in the ink level in the main reservoir 10 measured using means 15 and the controller 3. For example, this is the case if the variation of the ink level is less than a threshold value (for example 5/10 mm) for a predetermined duration (for example 20 s), when the pump 31 is in operation to inject ink to the main reservoir 10. On the other hand, if the variation in the ink level during said predetermined duration is more than the threshold value, the cartridge 30 is not empty. If a cartridge is in position but is empty, the cleaning operations will not take place.

Means 100 and 50 have been disclosed above separately. An example of operation of the means 100 and 50 will be disclosed below.

As already mentioned, solvent can be sent to means 50 directly without passing through either the umbilical 19 or the print head 1.

According to one particular embodiment, solvent is not sent to other means in the circuit, particularly to means 300. Solvent is then sent only to means 50.

Possibly, pressure in means 50 may be detected for example by sensor 47 when the means 100 and 50 are in fluid communication. In the example embodiments in FIGS. 4 and 5, this means that the valve 51 is in the <<NC>> position. This detection may be made by the controller that processes pressure measurements.

If this detection takes place when the recovery pump starts, or shortly after this pump starts, detection of a negative pressure variation, for example of the order of −50 mbars (or a negative pressure variation for which the absolute value is more than a given predetermined value, for example 50 mbars) relative to atmospheric pressure, can conclude that the means 50 are in good functional condition. Once again, this conclusion is reached by the controller (but it could also be an operator).

Otherwise, a sequence to unblock means 50 may be applied.

For example, after having created a fluid isolation between means 50 and means 100 (no fluid flows between them), the solvent in circuit 100 is pressurised until it reaches a predetermined pressure value, for example between 1 and 5 bars. Fluid communication between means 50 and means 100 is then restored.

An unblocking test may take place, for example on the volume of solvent that has passed to means 50 (a method is to measure the volume contained in the reservoir 14); if this volume reaches a predetermined value, for example a few $cm^3$ for a predetermined duration $\Delta t_0$, this means that flow has been restored in means 50 and that they are therefore unblocked, this is the end of the sequence.

Otherwise, at least one cycle may be performed to close and then open the fluid communication between means 50 and means 100, which can result in pressure <<surges>>.

This cycle may be stopped as soon as the unblocking test is positive (as described in the above example, the measured solvent volume reaches the predetermined value for the duration Δt): flow has been restored once again in means 50 which are therefore unblocked.

Otherwise, this cycle may possibly be repeated, for example until an unblocking time has elapsed and/or a new pressure test can be carried out in means 50, as explained above. According to one particular embodiment, if N pressure tests have already been carried out (N>1, for example N=2), the method can be interrupted to signal an anomaly or a fault.

Figure 8:
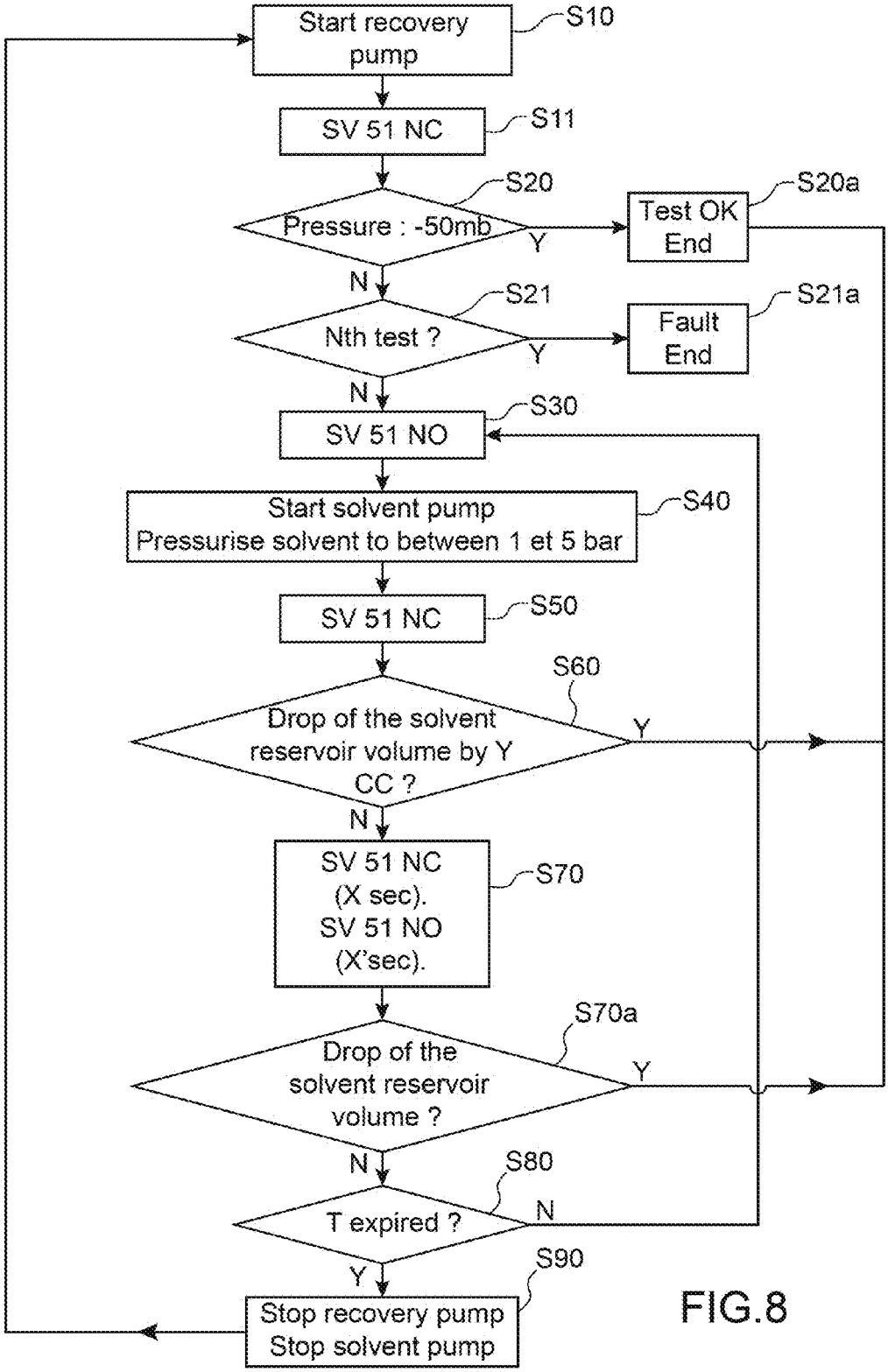
FIG. 8 shows steps in implementing an example of a cleaning method using solvent, according to this invention.

One example embodiment of such a method is described with reference to FIG. 8.

When the printer is started, the pump 53 is started (step S10), preferably after waiting for a timeout of a few seconds.

Solvent is then sent (step S11) to means 50, from means 100 (the solenoid valve 51 is in the <<NC>> position in the embodiment in FIG. 5A or, in the embodiment in FIG. 5B, valve 51-2 is open while valve 51-1 is closed).

Pressure in means 50 may be detected (step S20), for example using the sensor 47; a check is made whether the pressure variation is less than a certain predetermined value, for example −50 mbars (or if the pressure variation is negative but its absolute value is higher than a given predetermined value, for example 50 mbars), for a predetermined duration $\Delta t_0$.

If it is, the module 50 operates correctly, therefore this is the end of the test (step S20*a*) and the machine can start.

Otherwise (S21), a check is made to see if it is the $N^{th}$ (N>1; for example N=2) pressure test in means 50, and in this case a fault is signalled (step S21*a*). If the number of pressure tests is less than N, a sequence called the unblocking sequence is started (steps S30-80).

The fluid communication between means 50 and means 100 is closed (step S30; the solenoid valve 51 moves into the <<NO>> position in the embodiment in FIG. 5A or, in the embodiment in FIG. 5B, valve 51-1 is open while valve 51-2 is closed).

The solvent in circuit 100 is pressurised (step S40; start pump 41) until a pressure value equal for example to between 1 and 5 bars is reached.

The fluid communication between means 50 and means 100 is once again open (step S50; the solenoid valve 51 has changed to the <<NC>> position in the embodiment in FIG. 5A or, in the embodiment in FIG. 5B, valve 51-2 is open while valve 51-1 is closed).

The volume of the solvent reservoir 14 is then checked (step S60); if this volume drops by a given value ΔV, for example a few $cm^3$ for a predetermined duration Δt, this means that flow in means 50 has been restored and that they are therefore unblocked, which is the end of the sequence (step S20*a*).

Otherwise, (therefore, if the volume of the solvent reservoir 14 does not drop or does not drop sufficiently to reach the value ΔV mentioned above), a closing and opening cycle of the fluid communication between means 50 and means 100 (step S70) can then be made. According to the embodiment shown, this is a cycle to close (in the <<NO>> position for X seconds) and then to open (in the <<NC>> position for X' seconds) the valve 51 (in the embodiment in FIG. 5A) or (in the embodiment in FIG. 5B), to open valve 51-2 and close valve 51-1 and then to open valve 51-1 and to close valve 51-2. Pressure <<surges>> are thus generated.

This cycle can be stopped as soon as it is detected that the volume of the solvent reservoir 14 drops to reach the value ΔV for the predetermined duration Δt (step S70*a*); this means that flow has been restored in means 50 and that they are therefore unblocked, this is the end of the sequence (step S20*a*).

Otherwise, and if a certain duration T called the unblocking time (for example T is equal to a few tens of seconds) has elapsed since the beginning of the unblocking sequence (step S80), then the pumps are stopped (step S90) and the process returns to step S10. Steps S11 and S20 are repeated. If the test in step S20 is positive, starting of the printer can continue.

A fault is signalled (S21*a*) after N pressure tests.

As mentioned above, regardless of which embodiment is used, a blocked situation of means 50 can preferably be detected using the machine controller. The controller will:

- make the decision and send the instruction to make solvent flow under pressure towards means 50;
- and/or process the information from the level sensor 14' and/or the pressure sensor 47 to pump solvent under pressure, depending on measured value(s) of the level and/or the pressure (of solvent) (in means 50);
- and/or open or close the valve 51 (or the valves 51-1 and 51-2, one of said valves being closed while the other one is open).

The controller is programmed to detect a blocked situation of means 50 and/or to implement one or more of the above steps for unblocking means 50. Means 100 and 300 have been described above separately. An example operation of means 100 and 300 will be disclosed below.

Circulation of pressurised solvent through means 300 can dissolve or destroy plugs of ink residue that may be formed in the conduits 320, 343, 344, 345, 346, 347 and possibly 348, followed by ink during the different operating phases of the printer, or in the valve(s) 35, 33 or in the cannula 301. Fluid connections can thus be cleaned, which is particularly useful to apply, notably after the cartridge 30 has been emptied and before it has been removed for replacement by a full cartridge.

After being directed to the cartridge 30, the solvent can then be pumped to the main reservoir 10. The solvent path is then the path normally followed by ink (FIG. 6, path through conduits 343, 344, 347), from the cartridge 30 to the main reservoir 10: after cleaning, the valve 35 changes from the NO state (<<32>>) to the NC state (channel <<12>>) and the pump 31 is activated to transfer cleaning solvent to the reservoir 10 (the valve 33 being in the <<NO>> position). Therefore solvent can be used to clean the conduits in which it is circulating, and the cannula 301; it can then be kept in the circuit, without being lost.

Such a cycle (transfer of solvent, recovery in the main reservoir 10), may be reiterated.

Preferably, cleaning by solvent takes place when the cartridge 30 is present but empty, which can be detected by variations in the measured level in the main reservoir 10, as described above.

The following describes one possible example of a cleaning sequence making use of the method described above:

a) 1st rinsing of conduits 343, 344, 348, valves 35, 33 and the cannula 301 by solvent under pressure, then recover the solvent in reservoir 10;

b) 2nd rinsing of the same conduits and the cannula 301 by solvent under pressure, then recover the solvent in reservoir 10;

c) final rinsing of the same conduits and the cannula 301 by solvent under pressure, without recovery to the reservoir 10; the fact that solvent is maintained in this step helps to avoid any subsequent blockage by maintaining solvent in the cartridge, thus preventing drying.

The <<empty>> state of cartridge 30 is detected prior to the cleaning operations described above making use of ink level measurements, for example level measurements made in the main reservoir 10 using means 15, and using the controller. The controller also makes the decision and sends instructions to circulate solvent under pressure towards the cartridge 30, and then to pump it towards the main reservoir 10.

It can be checked that the cartridge 30 is still in position before sending pressurised solvent to it, for safety reasons. This verification has already been described above. Like the cleaning method, this check can also be made using the controller.

Once the cleaning phases are complete, the cartridge 30 can be replaced by a full cartridge.

In the above description, it will be understood that both detection of the <<empty>> state of the cartridge 30 and the cleaning steps following this detection are triggered by the machine itself, without any operator intervention, and without the machine being stopped. The machine can simultaneously continue printing.

Another application of the invention relates to the case in which the cartridge 30 is not empty, and a blockage is detected on the ink path from the cartridge 30 to the main reservoir 10.

A blocking situation of one of the ink circulation conduits or the cannula 301 can be detected from pressure or solvent level measurements. This diagnostic can be made by the controller that processes pressure measurements, estimates the variation in the ink level in the reservoir for a given pumping duration and power, and compares it with what is normally expected under these pumping duration and power conditions.

According to one embodiment, when the printer starts or during its operation, a check is made to see whether or not connections are blocked when ink draw off is required. The following tests may be performed for this purpose, for example using the controller:

- measure the pressure variation when the circuit is opened (for example by swapping over valves 35 and 33 in FIG. 6); if there is no variation, it is concluded that there is a blockage;
- and/or measure the solvent level when the circuit is opened (for example by changing the position of, or swapping over, valves 35 and 33 in FIG. 6): if it does not vary, then it is concluded that there is a blockage.

According to the above description, solvent at pressure Ps=P1 for example between 1 and 10 bars, can then be injected towards the cartridge 30. The pressure Ps can be detected by the sensor 47. This injection can be made periodically.

If there is no blockage, or if the solvent eliminates an obstacle located on the path followed by the solvent, then the solvent pressure Ps drops to a value P2<P1. Solvent can then be reinjected into the main reservoir 10, as described above.

On the other hand, if the solvent pressure Ps remains stable, the controller will still diagnose a blocking situation. The pressure P1 is then held for a given time Δt1, for example a few seconds, to give time for the obstacle to be flushed out. This may possibly be combined with one or several pressure surges (or variations or pulses) for example by cycles consisting of opening and closing the solenoid valve 35 to reach a pressure P3>P1, each of the pressure pulses being generated for a short time for example with duration Δt2<Δt1. If the pressure Ps then reduces to value P2<P1, the obstacle has been eliminated and solvent can be reinjected into the main reservoir 10, as described above. If the pressure Ps still does not drop, for example after a given duration that may be of the order of several tens of seconds, manual action can be taken and/or the cannula 300 or the ink module itself (that includes some of the fluid connections between the cartridge 30 and the main reservoir) can be replaced.

In all cases, solvent under pressure sent to the cartridge 30 can then be pumped to the main reservoir 10. The circuit is then the same circuit normally followed by ink from the cartridge to the main reservoir; after cleaning, the set of valves 33-35 is reconfigured to send cleaning solvent to the main reservoir 10. The solvent can then clean the conduits inside which it is circulating and the cannula 300, and can then remain in the circuit without being lost.

As described above, a blockage situation in one of the conduits or the cannula can be detected using the machine controller.

This controller will:

- make the decision and send the instruction to circulate solvent under pressure towards the cartridge 30;
- process information from the sensor 47, so that solvent can be pumped towards the main reservoir 10, or solvent pressure can be maintained in the conduits that are considered to be blocked.

As in the case of a cartridge described above, for safety reasons it can be checked that the cartridge 30 is still in position before any solvent is pumped under pressure to the cartridge. The means used for this purpose may be the same as those already described above (tag 30*a* and controller). It can firstly be checked whether or not the solvent level is sufficient, or is above a limiting lower value. This step can also be done when cleaning after the cartridge empty state has been detected, as described above.

Figure 9:
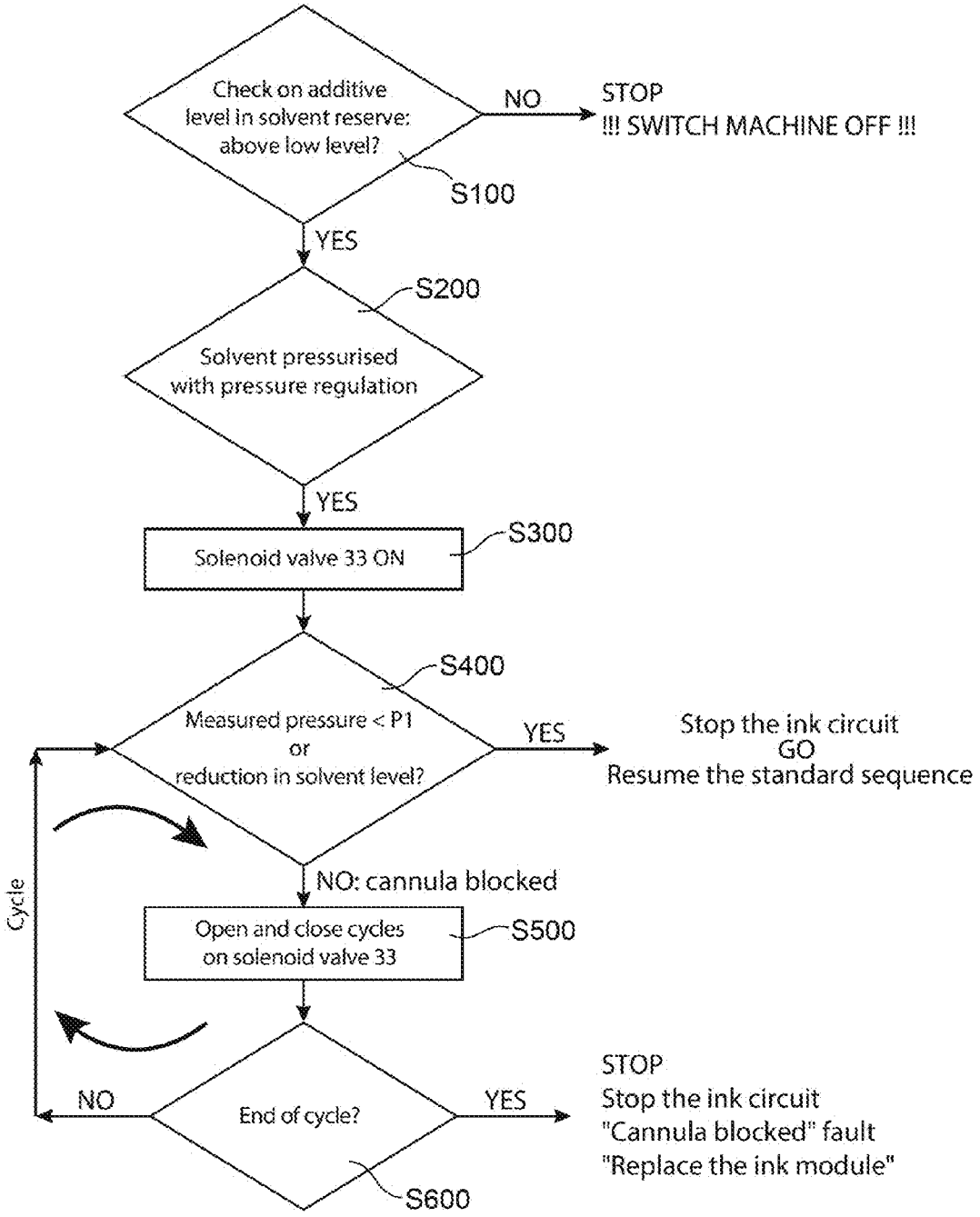
FIG. 9 shows steps in implementing another example of a cleaning method using solvent, according to this invention.

FIG. 9 shows an example embodiment of this method.

In a first step (S100), the solvent level in the intermediate solvent reservoir 14 is checked.

If this value is below a predetermined threshold value, then the printer is stopped immediately to prevent it from operating with no solvent. This step may also be done when cleaning after the cartridge empty state has been detected.

If this value is higher than this threshold value, then solvent can be pressurised (step S200), for example to a pressure P1 between 1 bar and 10 bars, or between 1 bar and 5 bars. If this pressure cannot be reached, a fault is detected. If this pressure can be reached, then solvent is sent (step S300) to the ink cartridge 30, according to the above description, by opening valve 33. More precisely, the valve 35 remains in position <<32>> (<<NO>>), solvent flows through valve 33 (in position <<21>>, NC), and opening/closing cycles will then be applied to generate pressure surges.

A test (step S400) can then be made to test whether the solvent pressure is maintained or is reduced over a given duration Δt1. For example, it can be tested if the pressure has reduced by a predetermined value at the end of this duration, for example between 1%×P1 and 50%×P1 or (for example by measuring solvent in the reservoir 14) if the solvent level or volume has reduced by a predetermined value Δh1 or ΔV1: if the answer to either of these questions is positive, it is considered that the circuit is unblocked and the standard functional sequence of the machine can be resumed.

Otherwise, it is considered that the ink circuit is blocked, and one can try (step S500), to temporarily increase the pressure, for example by pressure surges (or variations or pulses) (as described above), generated by one or several open and close cycles of the valve 33.

A test can also be made on the duration of cleaning or unblocking operations (step S600): if the duration of the cycle is longer than a predetermined duration Δt, it can be decided to stop cleaning and for example to replace the ink module. Otherwise, if the predetermined duration has not elapsed, the test in the previous step S400 can be repeated.

All the operations described above can be implemented by the machine controller, programmed for this purpose.

In other words, the machine itself can formulate and trigger the diagnostic of a blocking situation and the solution to this blockage, without any operator intervention and without the machine being stopped. The machine can continue to print simultaneously.

One example operation of means 100 and 10 will be disclosed below.

Solvent is allowed into means 300, and is then pumped to the main reservoir 10. The solvent path is then the path normally used by ink (FIG. 6, path through conduits 343, 344, 347): valve 35 is changed from the NC state (<<12>>) to the NO state (channel <<32>>) and pump 31 is activated to send cleaning solvent to the reservoir 10 (valve 33 being in the <<NO>> position). Therefore, solvent will supply the reservoir 10, so that in particular the composition of the ink contained in this reservoir can be adjusted.

Figure 10:
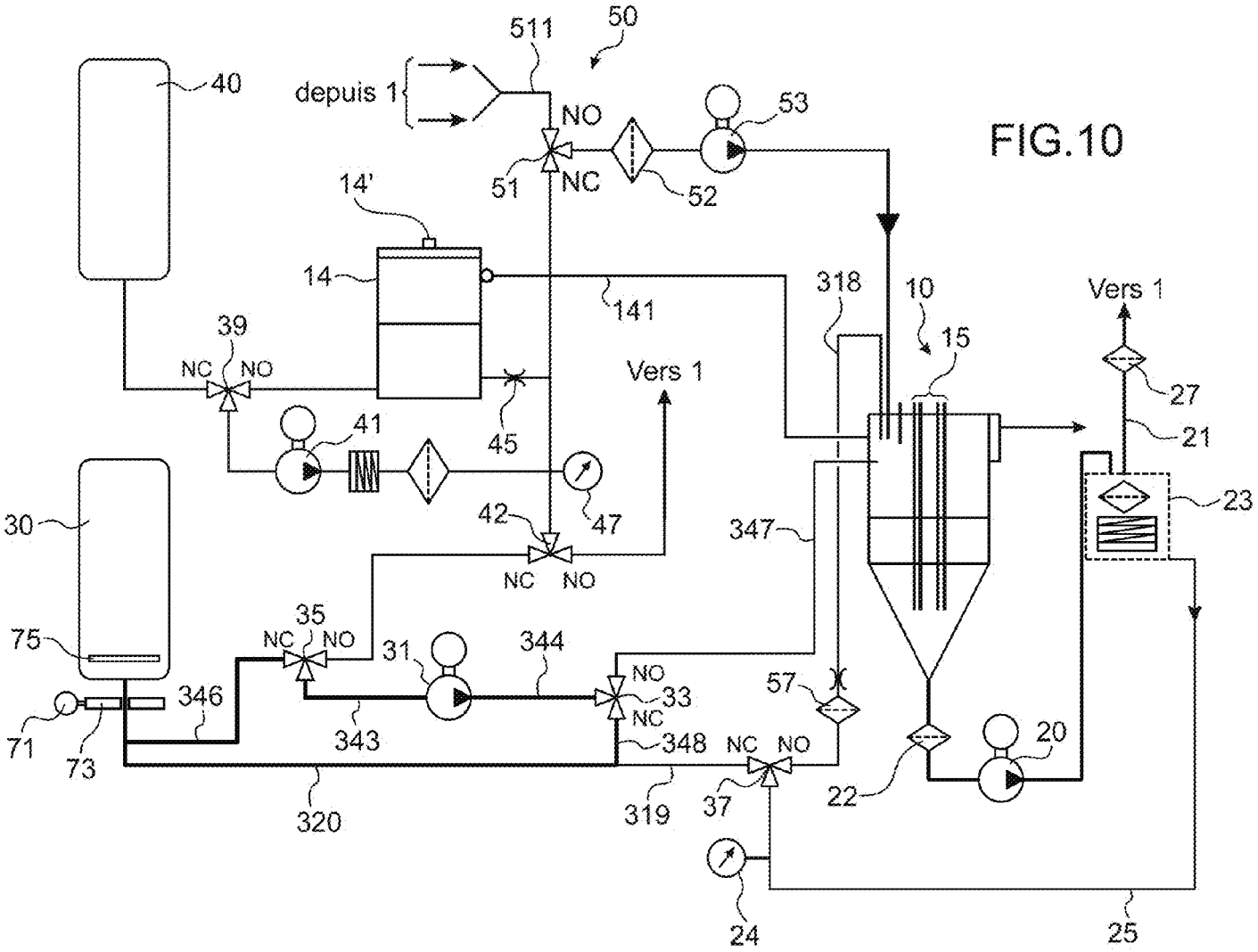
FIG. 10 shows an example of a fluid circuit structure according to this invention.

FIG. 10 shows an in ink circuit in which the circuit and the method described above, particularly with reference to FIGS. 3-9, can be used. The different means 10, 50, 100, 200, 300 described above are combined. In this figure, numeric references identical to those in the previous figures refer to identical or corresponding elements.

At the outlet from the main reservoir 10, there is a filter 22, and then the pump 20 and an anti-pulse device 23. A pressure and possibly temperature sensor 24 may be provided as shown in the figure; data output by this sensor are used by the controller to slave the ink pressure to a set value, usually when the velocity of the ink jet in the head is not available (for example when ejection of the jet is stopped, or when the jet velocity cannot be measured). As described above, ink is transferred to the print head 1 through the conduit 21 connected on the downstream side of the anti-pulse device 23, between the pump 20 and the valve 37. The print head itself contains a valve that enables or disables production of an ink jet and possibly printing.

Ink is filtered by the main filter 27 before being sent to the head 1.

The intermediate reservoir 14 has been described above. A conduit 141 can be used to bring the free volume located above each of the liquids contained in the reservoirs 10 and 14 to the same atmospheric pressure.

It should be noted that when the valve 42 is in the <<NC>> position while valve 35 is in the <<NC>> position, solvent flow is blocked both towards the cartridge 30 and towards the conduit 343; therefore, solvent is thus directed to valve 51 or to restriction 45 (and then enters the intermediate reservoir 14).

The invention is particularly useful for ink containing dense particle dispersions such as metals or metal oxide pigments, for example titanium, zinc, chromium, cobalt or Iron (such as $TiO_2$, ZnO, $Fe_2O_3$, $Fe_3O_4$, etc.) in the form of micronic or sub-micronic particles. Such a pigment ink can for example be based on $TiO_2$, and can be used for marking and identification of black or dark supports.

But it is also useful in the case of a non-pigment ink that can dry and form deposits of dry material in the conduits and connections of the ink circuit, as described above.

In the embodiments disclosed, a system can be provided for mixing ink from the cartridge, comprising:

a motor 71;

a magnet support 73.

A fastening screw can be used to fix the magnet support 73 onto the motor 71.

A magnetised bar 75 is inserted inside the ink cartridge 30. Interaction of these elements can rotate the magnet 75 inside the ink and thus stir ink in the cartridge.

The invention claimed is:

1. Method of cleaning a fluid circuit in an inkjet printer that comprises a print head connected to the fluid circuit by a flexible umbilical that contains hydraulic conduits for supply of ink and/or solvent to the print head and return of ink and/or solvent from the print head, wherein said fluid circuit includes:

a print head recovery circuit for recovering ink and/or solvent from the print head, and a solvent reservoir for storing solvent, said print head recovery circuit being arranged on the downstream side of the umbilical relative to the flow direction of ink and/or solvent that return from the print head, this method including at least sending solvent from said solvent reservoir to said print head recovery circuit using a pump and fluid connections, without making this solvent flow from said solvent reservoir into the umbilical or into the print head.

2. Method according to claim 1, in which the fluid circuit also comprises a main reservoir, an ink supply circuit supplying ink to this main reservoir, and a hydraulic circuit to selectively allow solvent to enter this main reservoir, wherein the hydraulic circuit does not allow solvent to flow into the main reservoir at the same time as the solvent is being sent to said print head recovery circuit.

3. Method according to claim 2, in which when solvent is no longer being sent to said print head recovery circuit, then said hydraulic circuit is opened to allow solvent to enter the ink supply circuit.

4. Method according to claim 1, in which when sending solvent to said print head recovery circuit and to an ink supply circuit is stopped, then solvent is sent from said reservoir to the print head.

5. Method according to claim 1, in which when a blocked state of the print head recovery circuit is detected, then at least one step is performed to unblock said print head recovery circuit.

6. Method according to claim 5, the print head recovery circuit comprising a pump, a blocked state of the print head recovery circuit being detected by at least one measurement of the pressure variation during or after a start-up phase of said pump.

7. Method according to claim 6, in which a blocked state is detected if the absolute value of a detected pressure variation is less than a predetermined value.

8. Method according to claim 5, said at least one step to unblock said print head recovery circuit comprising sending solvent under pressure into said print head recovery circuit.

9. Method according to claim 5, in which an unblocked state is detected when a minimum volume ($\Delta V$) of recovered solvent flows towards the print head recovery circuit.

10. Circuit to recover fluid from a print head of an inkjet printer, said print head being designed to be connected to a printer body through a flexible umbilical that contains hydraulic conduits to supply the print head with ink and/or solvent and to return the ink and/or solvent from the print head, said circuit, designed to be on the same side of the umbilical as the printer body, said circuit comprising at least one pump and hydraulic connections for selecting a supply of said pump, such that at any one time, said supply consists exclusively of ink and/or solvent recovered from said print head, or of clean solvent that has not flowed through the umbilical or into the print head.

11. Circuit according to claim 10, in which said hydraulic connections for selecting a supply of said pump, either with a recovered fluid or with solvent, comprise at least one valve.

12. Circuit according to claim 10, comprising a detector to detect a blocked state of the circuit to recover fluid or to detect a pressure variation during or after a start-up phase of said pump.

13. Circuit according to claim 12, also comprising a detector to detect if the absolute value of said pressure variation is greater or less than a predetermined value.

14. Circuit according to claim 12, also comprising hydraulic connections for performing at least one step for unblocking the said circuit to recover fluid.

15. Circuit according to claim 14, said hydraulic connections sending solvent under pressure into the circuit to recover fluid.

16. Circuit according to claim 10, comprising a sensor to detect a solvent volume sent to the circuit to recover fluid.

17. Solvent supply circuit for an inkjet printer, this printer comprising a print head, an ink supply circuit and a print head recovery circuit for recovering ink and/or solvent from the print head, the ink supply circuit being separate from the print head recovery circuit, the solvent supply circuit comprising:

a reservoir to store solvent, first hydraulic connections to send solvent from the reservoir to the ink supply circuit, without solvent flowing into the print head and without solvent being sent to the print head recovery circuit, second hydraulic connections to send solvent from the reservoir to the print head, and third hydraulic connections to send solvent from the reservoir to the print head recovery circuit, without solvent flowing into the print head and without solvent being sent to the ink supply circuit.

18. Inkjet printer comprising:

a print head;

a solvent supply circuit;

an ink supply circuit; and a circuit according to claim 10, to recover fluid from said print head, said solvent supply circuit comprising:

a reservoir to store solvent, first hydraulic connections to send solvent from the reservoir to the ink supply circuit, without solvent flowing into the print head and without solvent being sent to the circuit to recover fluid from the print head, second hydraulic connections to send solvent from the reservoir to the print head, and third hydraulic connections to send solvent from the reservoir to the circuit to recover fluid from the print head, without solvent flowing into the print head and without solvent being sent to the ink supply circuit.

19. Inkjet printer according to claim 18, the solvent supply circuit alternately sending solvent to either the print head, or to the circuit to recover fluid from said print head, or to the ink supply circuit.

* * * * *